US005903110A

United States Patent [19]

Pol et al.

[11] Patent Number: 5,903,110

[45] Date of Patent: May 11, 1999

[54] IGNITING CIRCUIT OPERATED BY VARYING THE IMPEDANCE VALUE OF THE CONTROLLER

[75] Inventors: Nicolaas H. M. Pol; Paul R. Veldman, both of Oss, Netherlands

[73] Assignee: U.S. Philips Corporation, New York, N.Y.

[21] Appl. No.: 08/888,903

[22] Filed: Jul. 7, 1997

[30] Foreign Application Priority Data

Sep. 6, 1996 [EP] European Pat. Off. ..... 96202482

[51] Int. Cl.[6] ..... H05B 37/02; H05B 37/00

[52] U.S. Cl. ..... 315/307; 315/224; 315/291; 315/DIG. 5; 315/360

[58] Field of Search ..... 315/224, 219, 315/311, 291, DIG. 5, 238, 240, 360, 307

[56] References Cited

U.S. PATENT DOCUMENTS 4,532,456 7/1985 Knoll et al. ..... 315/223
4,937,498 6/1990 Bolhuis et al. ..... 315/240
4,949,016 8/1990 De Bijl et al. ..... 315/224
5,569,984 10/1996 Holtslag ..... 315/307
5,670,849 9/1997 Melai ..... 315/224

*Primary Examiner*—Don Wong
*Assistant Examiner*—Wilson Lee
*Attorney, Agent, or Firm*—Bernard Franzblau

[57] ABSTRACT

A circuit arrangement for igniting and operating a discharge lamp (1) comprising inductive means, which include a primary winding (PRIM) which passes a high-frequency current during ignition and during lamp operation, and a secondary winding (SEC) which is magnetically coupled to the primary winding and electrically coupled to an impedance M (C1, C3) for limiting the current passed by the secondary winding. The current through the secondary winding generates a DC voltage via rectifying means, by which current a part of the circuit arrangement is supplied. The circuit arrangement is also provided with apparatus X (R, S1) for increasing the impedance value of the impedance M after ignition of the discharge lamp. The amplitude of the DC voltage is thereby at a desired level both before and after ignition of the discharge lamp, while no major power dissipation takes place during stationary lamp operation.

20 Claims, 1 Drawing Sheet

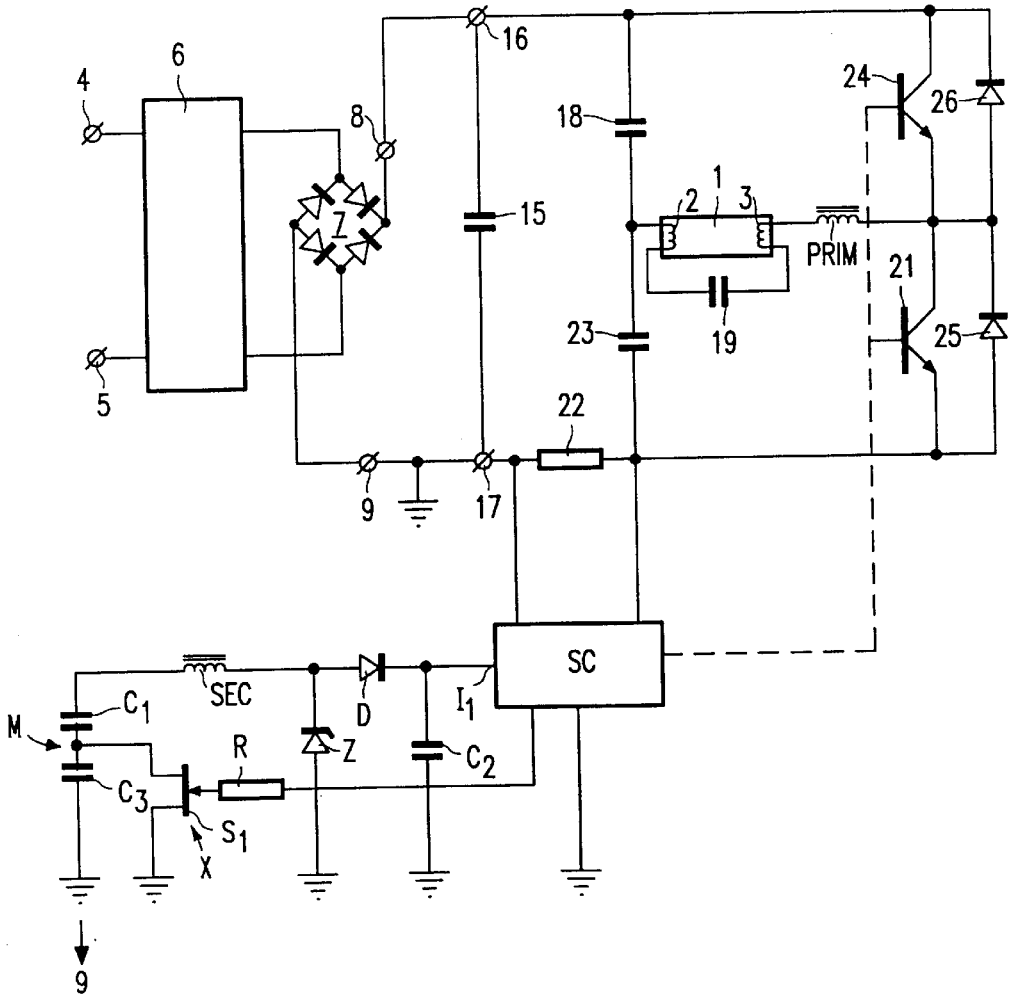
4
6
5
8
16
15
18
1
2
3
PRIM
19
23
24
26
21
25
22
9
17
SC
SEC
D
I1
M
C1
C3
R
Z
C2
S1
X
9

IGNITING CIRCUIT OPERATED BY VARYING THE IMPEDANCE VALUE OF THE CONTROLLER

BACKGROUND OF THE INVENTION

This invention relates to a circuit arrangement for igniting and operating a discharge lamp, comprising input terminals for connection to the poles of a supply voltage source, means I coupled to the input terminals for generating a current through the discharge lamp from a supply voltage delivered by the supply voltage source, which means are provided with a control circuit for controlling the operational state of the circuit arrangement, inductive means comprising a primary winding which carries a high-frequency current during ignition and during lamp operation, and a secondary winding which is magnetically coupled to the primary winding and is electrically coupled to an impedance M for limiting the current carried by the secondary winding, and to an input of the control circuit via rectifying means.

Such a circuit arrangement is known. The means I may comprise, for example, a preconditioner such as an up-converter for generating a DC voltage from the supply voltage. Such a preconditioner is provided with a high-frequency operated switching element and with an inductive element across which a high-frequency AC voltage is present during operation of the means I. It is also possible for the means I to comprise a DC-AC converter for generating a high-frequency lamp current from a DC voltage. This DC-AC converter often uses one or several switching elements which are operated at a high frequency and an inductive element across which a high-frequency voltage is present during operation. The control circuit of the known circuit arrangement comprises means for generating control signals for rendering the switching elements of the preconditioner and/or the DC-AC converter conducting and non-conducting and controlling the operational state of the circuit arrangement in this manner. The control circuit is supplied with a DC voltage of comparatively low amplitude when the circuit arrangement is in operation. This DC voltage may be generated with the aid of the inductive element present in the preconditioner or of the inductive element present in the DC-AC converter. This inductive element then forms the inductive means mentioned in the opening paragraph and comprises a secondary winding. A high-frequency voltage is present across the primary winding during operation of the circuit arrangement. The magnetic coupling causes a high-frequency voltage to be present also across the secondary winding. The DC voltage is generated by means of the high-frequency voltage present across the secondary winding and the rectifying means and is applied to the input of the control circuit. If the inductive means form a part of the DC-AC converter, however, the amplitude of the voltage across the primary winding will often be considerably lower during preheating of the electrodes of the lamp than during stationary lamp operation.

As a result of this, the amplitude of the voltage across the secondary winding during preheating of the discharge lamp is also much lower than during stationary lamp operation. If a sufficient amount of power is to be supplied to the input of the control circuit also during preheating, it is necessary to choose the impedance value of the means M to be comparatively low. This has the result, however, that the current through the secondary winding is comparatively strong during stationary lamp operation as a result of the comparatively high voltage across the secondary winding, which means that the voltage at the input of the control circuit reaches too high a value. This latter effect may be counteracted through the use of a voltage limiter such as a zener diode. The use of such a voltage limiter does have the result that the voltage at the input of the control circuit is no longer too high, but the voltage limiter passes current continuously and accordingly dissipates power continuously, which means that the circuit arrangement functions comparatively inefficiently.

SUMMARY OF THE INVENTION

The invention has for its object to provide a circuit arrangement in which a DC voltage suitable for the control circuit is present at the input of the control circuit both before and during ignition of the discharge lamp and during stationary operation, while also comparatively little power is dissipated by the circuit arrangement during stationary lamp operation.

According to the invention, a circuit arrangement as described in the opening paragraph is for this purpose characterized in that the circuit arrangement is provided with means X for increasing the impedance value of the impedance M after ignition of the lamp.

Since the means X increase the impedance value of the impedance M after ignition of the discharge lamp, the current through the secondary winding is limited and it is prevented that the voltage at the input of the control circuit reaches too high a value. It is realized thereby that the amplitude of the DC voltage with which the control circuit is supplied is maintained at a level suitable for the control circuit both during ignition and during stationary lamp operation.

It was found to be advantageous in practice for the impedance M to comprise a first and a second impedance element, and for the means X to comprise a switching element S1. The impedance elements may be, for example, ohmic resistors which are connected in parallel by the switching element S1 before and during ignition, while during stationary lamp operation one of the two resistors does not pass current because it is blocked by the switching element S1. It is also conceivable that during stationary lamp operation the two ohmic resistors are connected in series, while one of the resistors is shunted by the switching element during ignition. It is more advantageous, however, if the two impedance elements are capacitors, because the power dissipation in the impedance elements will be much lower in that case. These capacitors may be, for example, connected in parallel for ignition, whereas one of the capacitors passes no current during stationary lamp operation because it is blocked by the switching element S1. It is also possible to use the two capacitors in series during stationary lamp operation, one of the capacitors being shunted by the switching element before and during ignition.

The amplitude of the DC voltage at the input of the control circuit may be maintained within comparatively narrow limits if the secondary winding is coupled to voltage-limiting means. These voltage-limiting means may comprise, for example, a zener diode.

It was found to be advantageous, furthermore, to couple the input of the control circuit to capacitive means. These capacitive means act as a buffer capacitance. A stabilization of the DC-voltage at the input of the control circuit is achieved by this feature.

In a preferred embodiment of a circuit arrangement according to the invention, the means X comprise a timer circuit. This timer circuit increases the impedance value after a predetermined time interval has elapsed. It may be realized in this manner, for example, that the impedance M is increased after the preheating period of the lamp electrodes has passed.

Good results were obtained with circuit arrangements according to the invention in which the primary winding of the inductive means is connected in series with the discharge lamp during ignition and lamp operation.

BRIEF DESCRIPTION OF THE DRAWING

An embodiment of a circuit arrangement according to the invention will be explained in more detail with reference to the accompanying drawing. In the drawing:

FIG. 1 is a diagram of an embodiment of a circuit arrangement according to the invention.

DESCRIPTION OF THE PREFERRED EMBODIMENTS

FIG. 1 shows input terminals 4 and 5 for connection to the poles of a supply voltage source. All other components together form a means I coupled to the input terminals for generating a current through a discharge lamp 1 connected to the circuit arrangement from a supply voltage delivered by the supply voltage source. SC is a control circuit for controlling the operational state of the circuit arrangement. Primary winding PRIM and secondary winding SEC together form inductive means. Primary winding PRIM and secondary winding SEC are magnetically coupled. Primary winding PRIM is connected in series with the discharge lamp 1 and passes a high-frequency current during ignition and during stationary lamp operation. Capacitor C1 forms a first impedance element and capacitor C3 forms a second impedance element. Together capacitor C1 and capacitor C3 form a impedance M. Diode D forms rectifying means which couple secondary winding SEC to input I1 of the control circuit SC, to which input during operation a DC voltage of comparatively low amplitude is applied which serves as the supply voltage for the control circuit SC. Zener diode Z forms a voltage-limiting means which are coupled to the secondary winding SEC. The means X for increasing the impedance value of impedance M are formed by ohmic resistor R and switching element S1. Capacitor C2 forms a capacitive means to which the input of the control circuit is coupled.

Input terminals 4 and 5 are connected to respective inputs of diode bridge 7 via filter 6. Output terminals 8 and 9 of the diode bridge 7 are interconnected by a capacitor 15. A DC voltage is present across the capacitor 15 during operation of the circuit arrangement. Reference numerals 16 and 17 denote input terminals of a DC-AC converter for generating a high-frequency current from the DC voltage present across capacitor 15. The DC-AC converter is formed by capacitors 18, 23 and 19, switching elements 24 and 21, diodes 25 and 26, and the control circuit SC. A first side of capacitor 15 is connected to input terminal 16. A further side of capacitor 15 is connected to input terminal 17. Input terminal 16 is connected to input terminal 17 via a series arrangement of capacitor 18, capacitor 23, and ohmic resistor 22. The capacitors 18 and 23 are shunted by a series arrangement of switching element 24 and switching element 21 and by a series arrangement of diode 26 and diode 25. A common junction point of capacitor 18 and capacitor 23 is connected to a common junction point of switching element 24, switching element 21, diode 25, and diode 26 via a series circuit of capacitor 19 and primary winding PRIM. Discharge lamp 1 (provided with electrodes 2 and 3) shunts capacitor 19. Control electrodes of switching elements 24 and 21 are coupled to outputs of the control circuit SC. This coupling is indicated with a broken line in FIG. 1. Ends of ohmic resistor 22 are coupled to respective inputs of control circuit SC. Output terminal 9 is connected to ground and therby to input I1 of the control circuit SC via a series arrangement of capacitor C3, capacitor C1, secondary winding SEC, and diode D. Input I1 is also connected to output terminal 9 via capacitor C2. A common junction point of secondary winding SEC and diode D is connected to output terminal 9 via a zener diode Z. An output of the control circuit SC is connected to a control electrode of switching element S1 via ohmic resistor R. A first main electrode of switching element S1 is connected to a common junction point of capacitor C1 and capacitor C3. A second main electrode of switching element S1 is connected to output terminal 9.

The operation of the circuit arrangement shown in FIG. 1 is as follows.

When the input terminals 4 and 5 are connected to a supply voltage source which delivers a sinusoidal AC voltage with a frequency of approximately 50 Hz, this sinusoidal voltage will be rectified by diode bridge 7. As a result of this, a DC voltage is present across capacitor 15. The control circuit SC renders the switching elements 24 and 21 alternately conducting and non-conducting at a high frequency. As a result, a high-frequency current flows through the series circuit formed by primary winding PRIM, lamp electrode 3, capacitor 19, and lamp electrode 2 when the discharge lamp 1 has not yet ignited. This results in a high-frequency voltage across the primary winding PRIM. The high-frequency voltage across the primary winding PRIM induces a high-frequency voltage across the secondary winding SEC through the magnetic coupling between the primary winding PRIM and the secondary winding SEC. As long as the discharge lamp has not yet ignited, the amplitudes of the high-frequency voltages across primary winding PRIM and secondary winding SEC are comparatively low. At the same time, the output of control circuit SC connected to the switching element S1 via ohmic resistor R is high immediately after switching-on of the circuit arrangement, i.e. during preheating of the lamp electrodes, so that the switching element S1 short-circuits capacitor C3. The impedance M is formed by capacitor C1 before and during ignition, and the impedance value is comparatively low as a result. Since the impedance value of the impedance M is comparatively low, a current flows through the series circuit formed by switching element S1, capacitor C1, secondary winding SEC, and diode D which charges the capacitor C2 and whose amplitude is high enough for maintaining the voltage at input I1 of control circuit SC at the desired level, approximately 15 V in the present embodiment. A timer circuit forming a part of the control circuit SC makes the output of control circuit SC low after a predetermined time interval, so that the switching element S1 becomes non-conducting. The predetermined time interval is chosen such that the output of control circuit SC becomes low shortly after the lamp has ignited. The amplitude of the high-frequency voltage across primary PRIM rises after lamp ignition. As a result of this, the amplitude of the high-frequency voltage across secondary winding SEC also rises. When the switching element S1 is non-conducting, however, the impedance M is formed by the series circuit of capacitor C1 and capacitor C3, and the impedance value of the impedance M is comparatively high. The amplitude of the current which flows through the series circuit formed by capacitor C3, capacitor C1, secondary winding SEC, and diode D as a result of the high-frequency voltage across secondary winding SEC after the switching element S1 has become non-conducting is thus limited. As a result, the voltage at the input I1 of control circuit SC remains limited to the level of approximately 15 V suitable for the control circuit, while at the same time the zener diode Z does not dissipate a comparatively large amount of power. It is achieved thereby that the voltage at input I1 is kept at a level suitable for the control circuit SC both before and after a discharge has been generated in the discharge lamp 1.

During stationary lamp operation, the control circuit SC generates a signal which is a measure of the average value of the current through resistor 22. This signal is compared with a reference value. Depending on the outcome of this comparison, the control circuit SC adjusts the frequency and/or the duty cycle of the signals with which switching elements 24 and 21 are rendered conducting and non-conducting. The average value of the current through resistor 22 is maintained at a substantially constant value in this manner.

We claim:

1. A circuit arrangement for igniting and operating a discharge lamp, comprising:

input terminals for connection to terminals of a supply voltage source, means coupled to the input terminals for generating a current through the discharge lamp from a supply voltage delivered by the supply voltage source, said current generating means comprising;

a control circuit for controlling the operational state of the circuit arrangement, inductive means, comprising a primary winding which carries a high-frequency current during lamp ignition and during lamp operation, and a secondary winding which is magnetically coupled to the primary winding and is electrically coupled to an impedance M for limiting the current carried by the secondary winding, and the secondary winding is electrically coupled to an input of the control circuit via rectifying means, and the circuit arrangement includes means X for increasing the impedance value of the impedance M after ignition of the lamp.

2. A circuit arrangement as claimed in claim 1, wherein the impedance M comprises a first and a second impedance element, and the means X comprise a switching element coupled to at least one of said first and second impedance elements.

3. A circuit arrangement as claimed in claim 2, wherein the first and the second impedance elements comprise respective first and second capacitors.

4. A circuit arrangement as claimed in claim 1, wherein the secondary winding is also electrically coupled to voltage-limiting means.

5. A circuit arrangement as claimed in claim 1, wherein the input of the control circuit is coupled to capacitive means, and the control circuit controls the high frequency current in the primary winding.

6. A circuit arrangement as claimed in claim 1, wherein the means X comprise a timer circuit.

7. A circuit arrangement as claimed in claim 1, wherein the primary winding of the inductive means is connected in series with the discharge lamp during ignition and lamp operation.

8. A circuit arrangement as claimed in claim 1 wherein the electric coupling of the secondary winding to the input of the control circuit via the rectifying means provides a DC supply voltage for operation of the control circuit.

9. A lamp controller for a discharge lamp comprising:

input terminals for supplying an operating voltage for the lamp controller, means coupled to the input terminals and to a discharge lamp for supplying a current to the discharge lamp from the voltage at said input terminals, wherein said current supply means comprise;

a control circuit for controlling the operational state of the discharge lamp, inductor means comprising a magnetically coupled primary winding and secondary winding, said primary winding being coupled to the discharge lamp and said secondary winding being coupled to a supply voltage input of the control circuit via current rectifying means, at least one transistor switch coupled to an input terminal and to the discharge lamp via said primary winding, means coupling a control input of said at least one transistor switch to an output of the control circuit so that the one transistor switch is switched on and off at a high frequency by the control circuit thereby to cause a high frequency current flow through said primary winding during lamp ignition and during stable lamp operation, and the lamp controller further comprises:

an impedance means coupled to the secondary winding for limiting the current flow in the secondary winding, and means coupled to said impedance means for increasing the impedance value thereof after ignition of the discharge lamp and in a manner so as to limit the voltage at the supply voltage input of the control circuit during stable lamp operation.

10. The lamp controller as claimed in claim 9 wherein the impedance means comprise first and second impedance elements, and said impedance increasing means comprise a switching device coupled to at least one of said impedance elements and controlled by a further output of the control circuit.

11. The lamp controller as claimed in claim 10 wherein the first and second impedance elements comprise first and second capacitors connected in a series circuit to the secondary winding, and said switching device is coupled in parallel with one of said capacitors.

12. The lamp controller as claimed in claim 9 further comprising a capacitor coupled to said input of the control circuit.

13. The lamp controller as claimed in claim 9 further comprising means for connecting the primary winding in series with the discharge lamp during lamp ignition and stable lamp operation.

14. The lamp controller as claimed in claim 9 further comprising voltage limiting means electrically coupled to the secondary winding.

15. The lamp controller as claimed in claim 9 wherein a control input of the control circuit receives a signal determined by current flow in the primary winding thereby to control the frequency and/or duty cycle of said one transistor switch in a manner so as to regulate the current flow in said primary winding.

16. The lamp controller as claimed in claim 13 wherein a control input of the control circuit receives a signal determined by current flow in the primary winding thereby to control the frequency and/or duty cycle of said one transistor switch in a manner so as to regulate the current flow in said primary winding and in the discharge lamp.

17. The lamp controller as claimed in claim 10 wherein the switching device is held in a conductive state by said further output of the control circuit during lamp ignition and is held in a cut-off state by said further output of the control circuit during stable lamp operation.

18. The lamp controller as claimed in claim 9 further comprising a capacitor coupled to said input of the control circuit thereby to maintain a constant DC voltage at said supply voltage input of the control circuit.

19. The lamp controller as claimed in claim 9 wherein said discharge lamp has first and second electrodes and said current supply means further comprise a capacitor coupled across the lamp first and second electrodes.

20. The lamp controller as claimed in claim 14 wherein said voltage limiting means comprise a zener diode connected to a circuit node between the secondary winding and the current rectifying means.

* * * * *